US006558023B2

(12) United States Patent
Casciani et al.

(10) Patent No.: US 6,558,023 B2
(45) Date of Patent: May 6, 2003

(54) LUMINAIRE WHICH PROVIDES AN EVENLY DISTRIBUTED LIGHTING PATTERN

(76) Inventors: Stefano Casciani, Viale Umbria 78, Milan (IT), 20135; Susan Hakkarainen, 2300 Computer Ave., Suite I2, Willow Grove, PA (US) 19090; Mark Paul Jongewaard, 1630 Welton St., Suite 400, Denver, CO (US) 80202

( * ) Notice: Subject to any disclaimer, the term of this patent is extended or adjusted under 35 U.S.C. 154(b) by 0 days.

(21) Appl. No.: 10/012,933

(22) Filed: Dec. 10, 2001

(65) Prior Publication Data

US 2002/0089852 A1 Jul. 11, 2002

Related U.S. Application Data

(60) Provisional application No. 60/260,112, filed on Jan. 5, 2001.

(51) Int. Cl.[7] ..... F21V 11/06
(52) U.S. Cl. ..... 362/290; 362/310; 362/342
(58) Field of Search ..... 362/290, 310, 362/342; D26/89

(56) References Cited

U.S. PATENT DOCUMENTS 2,299,276 A * 10/1942 Kirlin ..... 362/290
6,161,939 A * 12/2000 Bansbach ..... 362/342
6,231,212 B1 * 5/2001 Cooney et al. ..... 362/290

OTHER PUBLICATIONS

U.S. patent application Ser. No. 29/129,925, Casciani, filed May, 2001, D26, 76.

* cited by examiner

*Primary Examiner*—Sandra O'Shea
*Assistant Examiner*—Ismael Negron
(74) *Attorney, Agent, or Firm*—Ostrolenk, Faber, Gerb & Soffen, LLP

(57) ABSTRACT

A luminaire capable of providing up-lighting when suspended from above, or mounted from below, or wall lighting when mounted as a sconce, having a longitudinally extended tapered hollow shell body which is open in the direction of intended illumination, a lamp mounting assembly, a fixture mounting assembly, and a louver assembly which is positioned between a lamp mounted in the fixture and the surface to be illuminated. The louver assembly is an integral unit having a supporting member which carries longitudinally spaced light-transmissive louvers which project from the body opening toward the illuminated surface. Each louver is formed of a partial disk which may be arcuate (e.g. semi-circular or semi-elliptical) or polygonal, and may have a beveled peripheral surface.

48 Claims, 13 Drawing Sheets

LUMINAIRE WHICH PROVIDES AN EVENLY DISTRIBUTED LIGHTING PATTERN

RELATED APPLICATION

This application is based on and claims priority to U.S. Provisional Patent Application No. 60/260,112, filed Jan. 5, 2001, entitled "MOUNTED LIGHTING FIXTURE."

BACKGROUND OF THE INVENTION

1. Field of the Invention

The present invention relates to lighting fixtures (hereafter referred to as "luminaires") which provide up-lighting, i.e. upwardly directed light. More particularly, the invention relates to luminaires of this type in which the upwardly directed light illuminates the ceiling extremely evenly.

The invention will be described in the context of a pendant type fixture, i.e., one which hangs from a ceiling, but the invention is also applicable to luminaires which are free-standing or mounted on tables, furniture or other raised horizontal surfaces, and to wall mounted units (e.g. sconces), or even angled down from a ceiling for wall illumination.

Luminaires according to the invention are capable of providing optional down-lighting, i.e. downwardly directed light components, as well as up-lighting.

2. Description of the Related Art

Luminaires which provide up-lighting are known. In such devices, important design considerations, apart from the overall aesthetics of the fixture, include both the extent and the uniformity of illumination. In some known devices, the latter consideration is not adequately addressed, and the light source within the fixture is mirrored on the ceiling, resulting in a relative "hot spot" in ceiling illumination. Of course, care must also be taken that technical requirements like uniformity of light distribution are not met at the expense of aesthetic considerations.

In known pendant fixtures which use elongated light sources like fluorescent tubes, achieving a uniform lighting pattern can sometimes be difficult. In particular, tubular lamps tend to project a bright line of light onto the ceiling running longitudinally directly above the fixture, with an "hourglass" pattern extending to the sides. Covering the lamp with a translucent diffuser or a louver array have been used to improve the uniformity of the lighting pattern, but these have had the effect of reducing the amount of upwardly directed light.

The problem can be particularly acute with tapered fixtures (i.e., fixtures in which the cross-section varies along the length) due to edge effects. Conventional fixtures are therefore usually linear, i.e., with no cross-sectional variation along the length, despite the esthetic appeal of tapered designs.

SUMMARY OF THE INVENTION

The present invention provides desirable uniformity of up-light distribution for elongated tapered luminaires that use tubular light sources, like linear fluorescent lamps, tubular double ended halogen lamps or the like, without unacceptable reduction in light output, or compromise of aesthetic considerations.

According to a first aspect of the invention, there is provided a lighting fixture comprised of an elongated tapered body having an axis of elongation extending in a first direction, the body including a cavity having an opening therein, mounting means for mounting the fixture with the cavity opening oriented toward a surface to be illuminated, lamp mounting means for positioning a lamp in the cavity so it extends in the first direction with the lamp exposed to illuminate the surface, and means for interacting with light emitted from the lamp so that the surface is illuminated a substantially uniform pattern extending in the first direction and transversely of the first direction.

According to a second aspect of the invention, there is provided a lighting fixture comprised of an elongated tapered body having an axis of elongation extending in a first direction, the body including a cavity having an opening therein, a fixture mounting assembly for positioning the fixture with the cavity opening oriented to provide lighting directed toward a surface, a lamp mounting assembly that positions a lamp in the cavity so it extends in the first direction, with the lamp exposed to provide illumination toward the surface, and a louver assembly including a plurality of louvers spaced along the axis of elongation, the louvers extending outward from the body cavity opening and transversely of the axis of elongation, the louver assembly being operative to direct light toward the surface to be illuminated in a substantially uniform pattern extending both in the first direction and transversely of the first direction.

Broadly stated, the desired uniform illumination according to the second aspect of the invention is achieved by provision of a louver assembly in which the louvers project from a cavity opening in the fixture body toward the surface being illuminated. The louvers are preferably of different sizes so that the louver assembly has a varying cross-section and profile from end to end.

In one embodiment according to the second aspect of the invention, the louvers may be partial disks having semi-circular perimeters with the disks becoming progressively smaller from the center of the fixture to the ends. The profile of the louvers preferably follows a smooth curve. The body is correspondingly tapered, so that when viewed from the side, the fixture appears to be ellipsoidal. This design is effective in producing a uniform light distribution without compromising the aesthetics of the luminaire.

In another embodiment according to the second aspect of the invention, the louvers are partial disks having semi-elliptical perimeters, and having their minor axes extending vertically. The minor axes of the louvers become progressively shorter from the middle of the fixture toward the ends. Again, the profile of the louvers may follow a smooth curve which matches that of the body so the fixture appears ellipsoidal when viewed from the side. This design is also effective in producing a uniform light distribution without compromising aesthetics. In this design, light is more broadly distributed i.e., transversely of the direction of elongation, than with the previous embodiment.

In a further embodiment according to the second aspect of the invention, the louvers are partial disks having semi-elliptical perimeters, with their major axes extending vertically. Again, the louvers vary in size progressively with the largest ones at the middle of the fixture and the smallest ones at the ends. This design produces a narrower band of illumination transversely of the fixture axis than in the case of the two embodiments previously described.

Other specific louver cross-sections may also be employed. The louvers may be parabolic, or even polygonal, to tailor the light distribution to a particular ceiling curvature, or for aesthetic effects.

According to a third aspect of the invention, there is provided a lighting fixture as described in connection with the first and second aspects, in which the surface to be illuminated is a ceiling. In a first embodiment according to the third aspect, the fixture mounting assembly includes members spaced along the fixture that extend upwardly for attaching the fixture to a ceiling. In a second embodiment according to the third aspect, the fixture mounting assembly includes members spaced along the fixture that extend downwardly for attaching the fixture to a surface below a ceiling being illuminated, such as a top surface of a kitchen island. In a variant of the second embodiment the spaced members may be attached to a base so the fixture may be free-standing.

In a further variant of the second embodiment, the spaced members may be attached to the top or to one side of the fixture to provide cantilever support.

According to a fourth aspect of the invention, there is provided a lighting fixture as described in connection with the first and second aspects, in which the surface to be illuminated is a wall, and the fixture is mounted on the wall being illuminated, or on a ceiling and aimed toward the wall.

According to one feature of the invention common to all aspects thereof, the louver assemblies are comprised of one or more integral structures installable and removable as complete units, whereby it is possible with a single overall fixture design, to control illumination for different lighting environments by choice of specific louver configurations.

According to a further feature of the invention common to all aspects, improved uniformity of illumination can be achieved by use of transparent or translucent, rather than opaque louvers. This permits the louvers to direct light more efficiently over a wider area of the illuminated surface.

For purposes of this description, the term "transparent" applies to a structure which does not obscure the visible features of an object lying beyond it. The term "translucent" applies to a structure which emits or passes diffuse light, but obscures objects lying beyond it. The term "opaque" applies to an object which is impenetrable to light.

Translucency can be achieved by selection of material or a treatment like sandblasting that produces a textured surface.

According to a yet another feature of the invention, the peripheries of the individual louvers may be transparent and beveled. This produces a controlled refraction of the exiting light rays, and enhances the uniformity of the up-lighting effect. Especially good results are achieved if the sides, i.e., the parallel faces of the louvers are translucent.

For beveled louvers, when the louvers are progressively shorter at the ends of the fixture than in the middle, the center louver or louvers are preferably flat, i.e. not beveled, and the beveled faces on opposite sides of the center face the respective nearest ends of the fixture. Alternatively, the beveled faces on opposite sides of the center may be reversed so they face toward the center of the fixture.

Uniform bevel angles, i.e., relative to the longitudinal axis of the fixture, may be employed on each louver (facing either inward or outward). Alternatively, the bevel angles may increase progressively toward the ends of the fixture, or the angle of individual louvers can be tailored. This permits control of the light distribution pattern in case the illuminated surface is not flat but is curved in some fashion.

An internal reflector may also be provided to further improve the distribution of the illumination.

According to a another feature of the invention, the louvers are attached to an elongated support structure which runs the length of the fixture. The support structure may be one or more rods or a partial tube, e.g., a semi-cylinder, surrounding the lamp and integral with the louvers. In the latter case, the partial tube may be opaque, but is preferably translucent or transparent.

Especially uniform light distribution can be achieved by beveling the tops of the louvers in an embodiment in which the vertical faces of the louvers and the portions of the semi-cylindrical support element between the louvers are translucent.

Other features and advantages of the present invention will become apparent from the following detailed description and the accompanying drawings.

DETAILED DESCRIPTION OF EMBODIMENTS OF THE INVENTION

Figure 1:
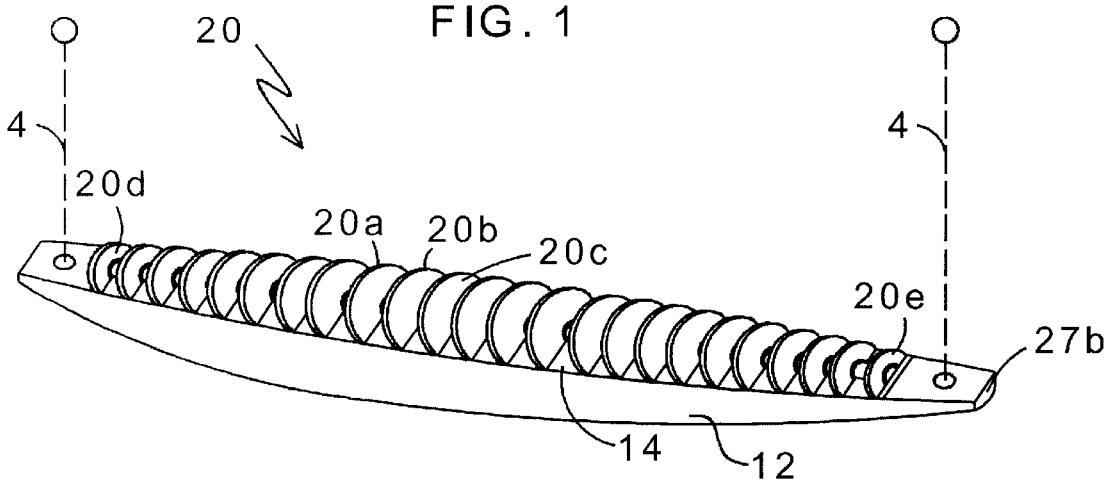
FIG. 1 is a perspective view of a first embodiment of a luminaire according to the invention.

Referring first to FIGS. 1–7, a luminaire according to one embodiment of the invention, generally denoted at 1, is illustrated as a pendant type fixture, and accordingly includes a mounting assembly comprised of suspension members 4 and 6 which may be hollow tubes, wire rope or the like, for attachment to a ceiling in any conventional or desired manner. As previously noted, however, the invention is also applicable to luminaires which are mounted on a surface below the ceiling being illuminated, for example a table, or are floor mounted, and to wall illumination units such as sconces mounted on the wall being illuminated, or on a ceiling but aimed at the wall.

Luminaire 1 is comprised of a tapered body 12 in the form of an elongated hollow half shell split that provides an open cavity 14 having an opening 26 surrounded by a flat margin 16. For the embodiment shown, cavity opening 26 faces upward, i.e., toward a ceiling to be illuminated when the fixture is installed. Body 12 is illustrated as having a semi-circular cross-section tapering toward both ends 27*a* and 27*b*, but may have any other tapering cross-section (e.g., semi-elliptical, or polygonal) such that its dimension transverse to the direction of elongation becomes progressively smaller outwardly from the center.

As illustrated, the ends 12*a* and 12*b* of body 12 are truncated at 27*a* and 27*b* respectively. Alternatively, however, the ends may be tapered to a point or a near point if desired.

A conventional mounting device (not shown) for an elongated lamp 18 is positioned within cavity 14. The lamp 18 may be one or more tubular sources such as linear fluorescent tubes, double-ended halogen lamps or the like. The use of so-called compact fluorescent lamps as well as "long twin" type fluorescent lamps is also possible. A single light source is illustrated, but several lamps arranged either end to end or in parallel or both, may also be employed.

Extending outwardly above cavity opening 26 is a louver assembly, generally denoted at 20, including individual louver 20*a*, 20*b*, etc. which are described in detail below.

In the illustrated embodiment, the individual louvers are comprised of partial disks having semi-circular perimeters. The disks at the center e.g., 20*a* and 20*b*, have a larger radius than those at the ends such as 20*c* and 20*d*, thereby defining the tapered profile for the louver assembly (see FIG. 3). Advantageously, the profile of the louvers is substantially matched to the profile and cross-section of body 12.

Figure 2:
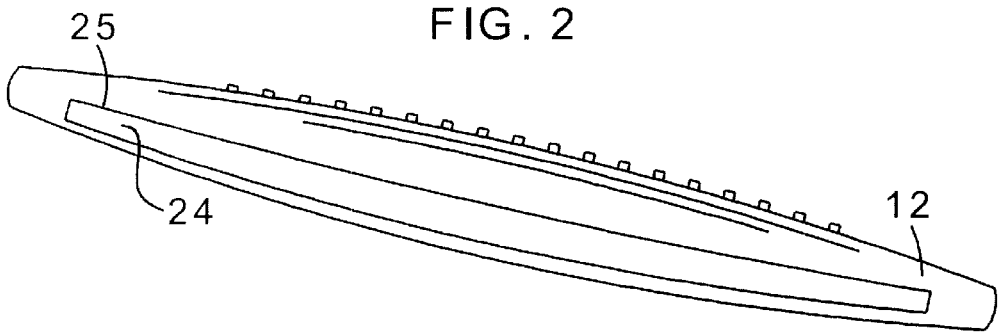
FIG. 2 is a perspective view of the under side of the luminaire shown in FIG. 1, showing the provision for down-lighting.

In the illustrated embodiment, luminaire 1 is adapted to provide both up-lighting and down-lighting. Accordingly, as shown in FIG. 2, a light transmissive diffuser plate 24 is provided in an opening 25 in the bottom of body 12. As will be understood by those skilled in the art, other arrangements may be provided to allow downward exit of light such as louvers or a perforated screen. In the case of a luminaire which provides up-lighting only, there will be no opening 25 in the bottom of body 12, or opening 25 may be closed by an opaque plate, rather than a diffuser.

The mounting devices for lamp 18 may be located in any suitable or convenient place to accommodate the positioning of the light source. In the illustrated embodiment, a single elongated fluorescent tube, is positioned at or slightly below the level of opening 26.

Other electrical components e.g., a ballast, a remotely controlled switch, etc may also be mounted in any convenient location within body 12, or at some convenient remote location. Operating power may be provided by a cable running through one of suspension members 4 or 6 if a hollow tube is employed, or along the length of the suspension member if it is in the form of a wire rope.

Figure 5:
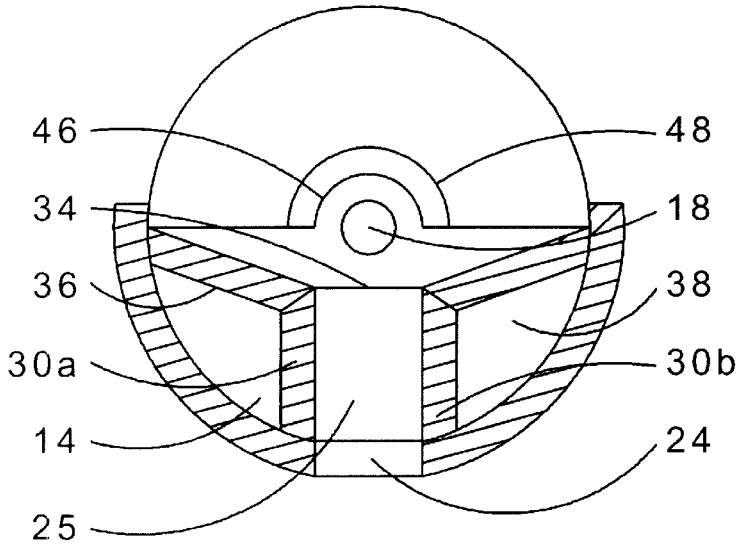
FIG. 5 is a cross-sectional view of the luminaire taken along line 5—5 in FIG. 4.
Figure 4A:
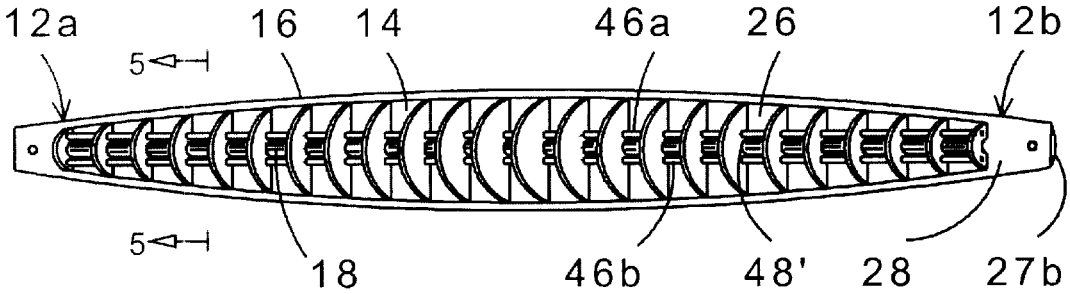
FIG. 4A is a view similar to FIG. 4 showing an alternative preferred embodiment.
Figure 5A:
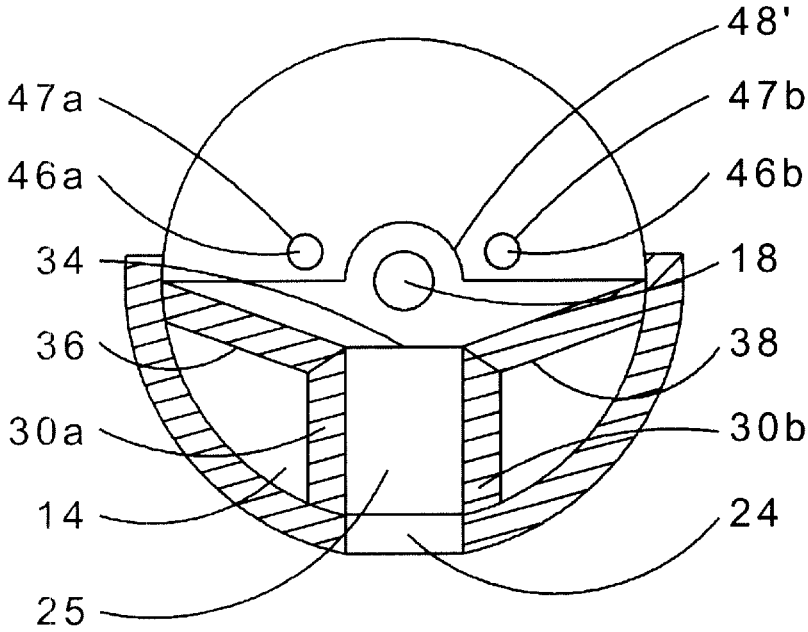
FIG. 5A is a view similar to FIG. 5 of the embodiment of FIG. 4A.

To provide downward transmission of light, a pair of longitudinally extending baffles 30*a* and 30*b* are provided (see FIG. 5). Baffles 30*a* and 30*b* are secured within body 12 in any suitable manner, as will be understood by those skilled in the art. Baffles 30*a* and 30*b* extend upwardly to a position just below lamp 18, to define the margins of a channel 34 which terminates at bottom opening 25. The latter, as noted above, is closed by diffuser plate 24 (see also, FIG. 2). Baffles 30*a* and 30*b* may be parallel as shown in FIG. 5 such that the width of channel 34 is constant. Alternatively, baffles 30*a* and 30*b* may be angled such that channel 34 is narrower at the top than at the bottom (or vice versa).

A reflector is provided below light source 18. This cooperates with louver assembly 20 as described below to provide the uniform light distribution achieved by the present invention. As shown in FIG. 5, the reflector may take the form of a pair of longitudinal plates 36 and 38 which extend laterally between the tops of respective baffles 30*a* and 30*b* and the inner walls of cavity 14. Plates 36 and 38 may be segmented so that several pairs of plates are positioned along the length of the fixture if desired. Alternatively, the reflector may be comprised of a single plate with a longitudinal slot at the center to permit light to enter channel 34. The plates comprising the reflector are secured within cavity 12 in any suitable manner as will be understood by one skilled in the art.

Reflector plates 36 and 38 are illustrated with their respective laterally outer ends higher than the respective laterally inner ends to form a Vee-shape. Alternatively, reflector plates 36 and 38 may be disposed horizontally, i.e., lying in a plane parallel to the opening 26 of body cavity 14, or even downwardly, i.e., toward each other in the "downward" direction to form an inverted Vee-shape.

Fixture body 12 may be formed by any suitable stamping or molding technique or the equivalent. It is also possible to form body 12 with baffles 30*a* and 30*b* and reflective plates 36 and 38 integral therewith, which would avoid the need for attachment during assembly. Light transmissive plate 24 may be press-fitted into the bottom of channel 34 as shown or designed for attachment to body 12 in any other suitable or convenient manner.

Figure 4:
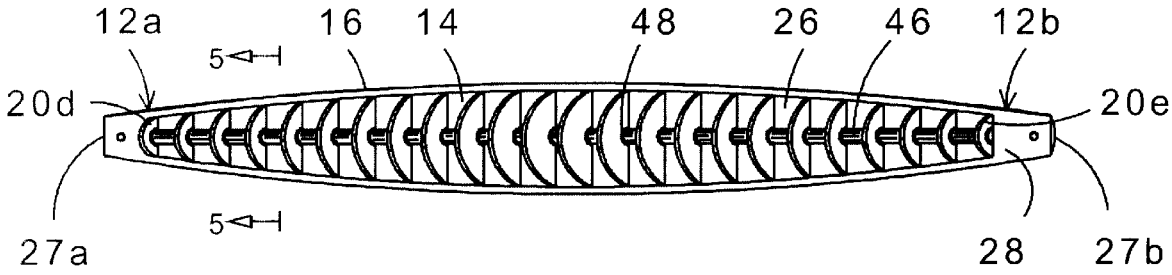
FIG. 4 is a perspective top view of the luminaire shown in FIGS. 1–3.
Figure 6:
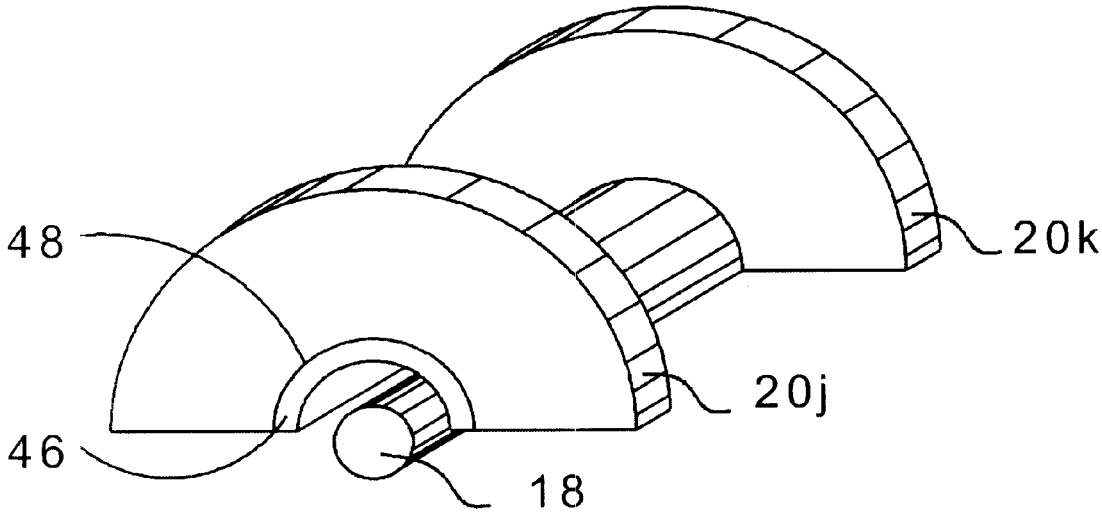
FIG. 6 is a fragmentary perspective view of a portion of the louver assembly shown in FIG. 4.
Figure 7:
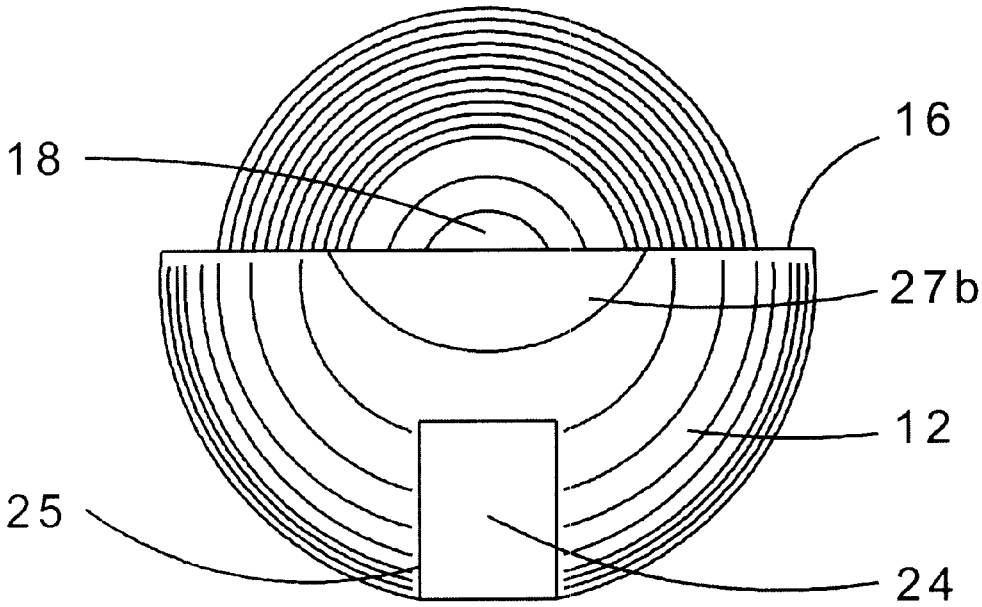
FIG. 7 is an end view of the luminaire shown in FIGS. 1–4, 5, and 6.
Figure 6A:
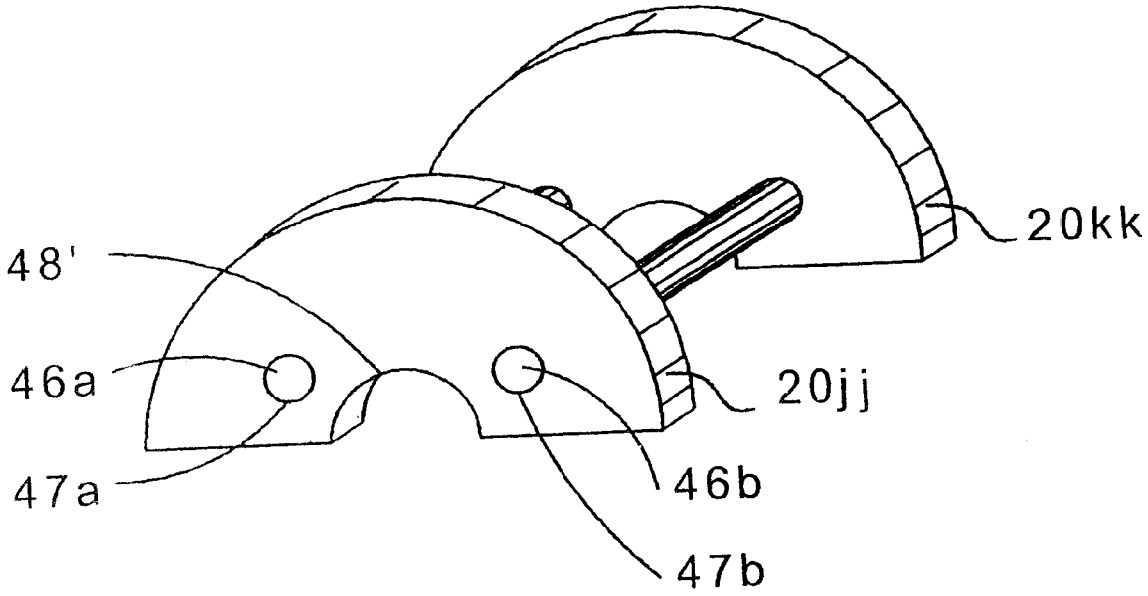
FIG. 6A is a fragmentary perspective view of the alternative embodiment of the louver assembly shown in FIG. 6.

The construction of one preferred embodiment of louver assembly 20 is shown best in FIGS. 4–6. Individual louvers such as 20*j* and 20*k* illustrated in FIG. 6, are mounted on an elongated support structure 46 in the form of a half-cylinder running the length of the fixture above and partially surrounding lamp 18 and received within semi-circular recesses or arches 48 formed in the bottoms of each louver. The individual louvers comprising the louver assembly 20 are secured to half-cylinder 46 in any suitable manner to provide an integral assembly.

An alternative preferred embodiment is shown in FIGS. 4A–6A. Here, the support structure is comprised of two parallel connector rods 46*a* and 46*b* which run the length of the fixture, and extend through openings 47 in louvers 20*jj* and 20*kk*. Recesses or arches 48' are formed in the bottoms of the louvers to provide clearance for a lamp 18. As in the case of the construction shown in FIGS. 4–6, the individual louvers comprising the louver assembly 20 are secured to half-cylinder 46 in any suitable manner to provide an integral assembly.

In both preferred embodiments, louver assembly 20 rests on top of the reflector without attachment for easy access to lamp 18 for replacement. The integral construction of louver assembly 20 thus facilitates easy access for installation and replacement of lamp 18, and also permits construction of a fixture of a particular size using a single body with louver assemblies having louvers of different configurations as needed to accommodate particular conditions of use.

The components of louver assembly 20, including the individual louvers, and support structure 46 (or 46*a* and 46*b*) may be opaque, translucent or transparent, as previously defined. Preferably, the individual louvers are formed of a suitable clear plastic such as polycarbonate, acrylic or the like. The sides may be made opaque or translucent, as explained below. Half-cylinder 46 and rods 46*a* and 46*b* may be formed of the same material as the louvers, and also may be transparent, opaque, or translucent.

Figure 3:
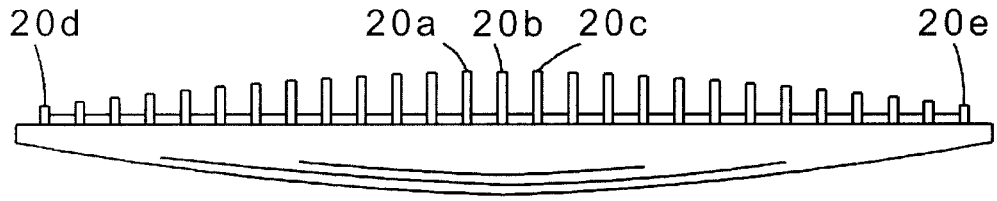
FIG. 3 is a side elevation of the luminaire shown in FIG. 1.
Figure 8A:
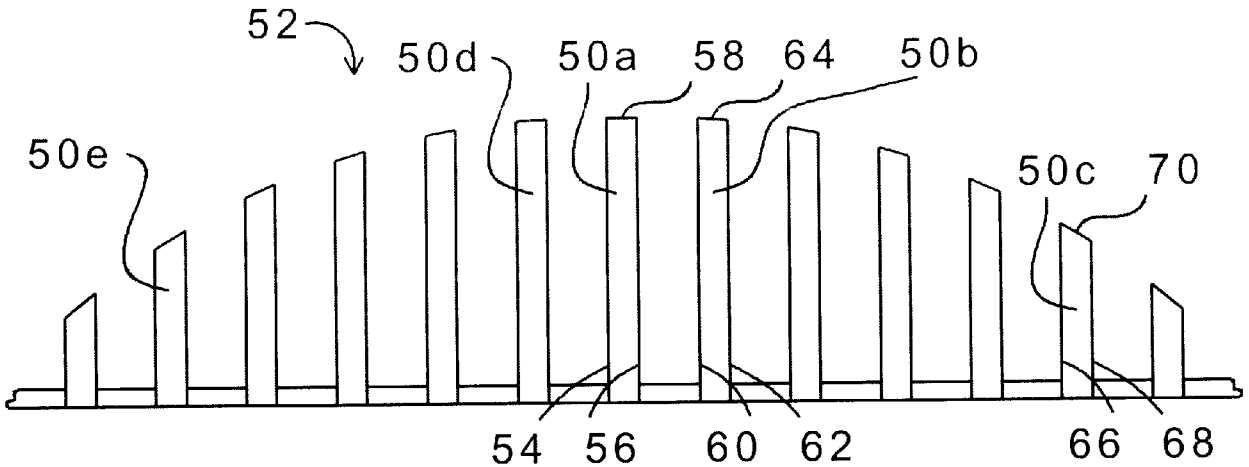
FIG. 8A is a fragmentary side elevation of a luminaire according to the invention in which the upper ends of the louvers are beveled.
Figure 8B:
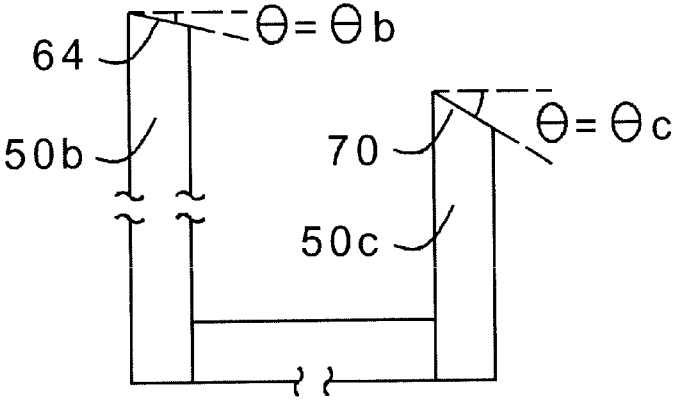
FIG. 8B is an enlarged view of a portion of FIG. 8A.

The peripherally outer surfaces of the individual louvers may be flat, as illustrated in FIG. 3, but according to this invention, it has also been found advantageous to bevel the individual louvers. Referring to FIGS. 8A and 8B, there are shown several louvers 50*a*–50*e* of a louver assembly 52. Louver 50*a* is the louver that is centrally located on the longitudinally axis of the fixture. Louver 50*a* is formed of a partial disk having longitudinally spaced side faces 54 and 56 and a peripheral outer face 58. Louver 50*b*, the one immediately to the right of louver 50*a* in FIG. 8A, is comprised of longitudinally spaced side faces 60 and 62 and a peripheral outer face 64. Louver 50*c*, one of the louvers at the right end of louver assembly 52, is comprised of longitudinally spaced side faces 66 and 68 and peripheral outer face 70.

As in the embodiment of FIGS. 1–7, it is preferred that the profile of louver assembly 52 be longitudinally symmetrical relative to a central louver 50*a*.

Still referring to FIGS. 8A and 8B, the outer face 58 of central louver 58*a* is substantially horizontal while the outer face 64 of louver 50*b* is slightly beveled at an angle $\theta=\theta_b$ and outer face 70 of louver 50*c* is beveled at an angle $\theta_c$ which is substantially greater relative to the horizontal than angle $\theta_b$. As may be understood, the bevel angles of the louvers between louvers 50*b* and 50*c* are progressively larger. Similarly, louver 50*d* immediately to the left of central louver 50*a* exhibits a small bevel angle which is equal and opposite to angle $\theta_b$. Louver 50*e* near the left end, which corresponds to louver 50*c* has a bevel angle which is equal and opposite to angle $\theta_c$ of louver 50*c*. Likewise, the intervening louvers between louver 50*d* and 50*e* have equal an opposite bevel angles to the corresponding louvers between louver 50*d* and louver 50*c*.

Figure 9A:
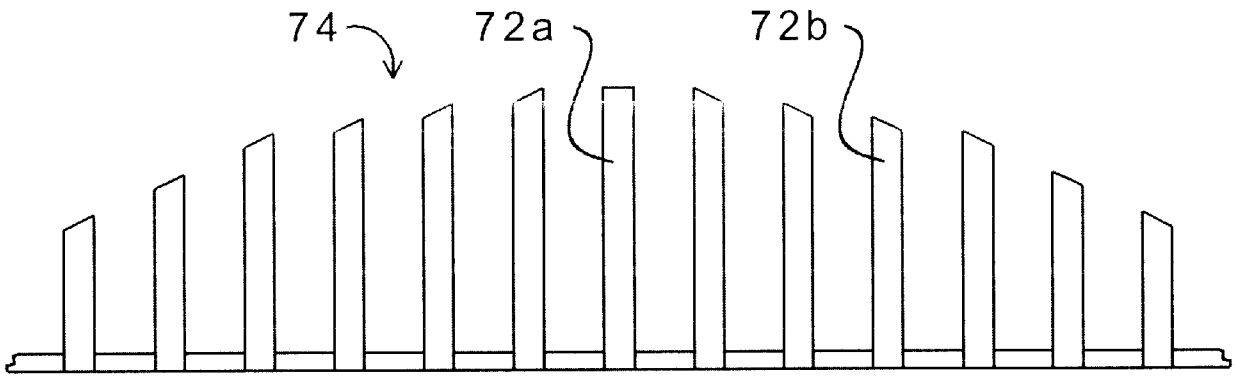
FIG. 9A is a fragmentary side elevation of a luminaire according to the invention showing an alternative construction for the upper ends of the louvers.
Figure 9B:
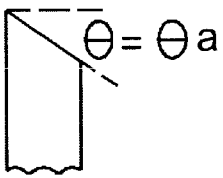
FIG. 9B is an enlarged view of a portion of FIG. 9A.

In the embodiment illustrated in FIGS. 8A and 8B, the bevel angles and the heights of the individual louvers match the profile of the louver assembly such that the longitudinally spaced louver faces fall on the curve defining the louver assembly profile. The bevel angles may, however, be selected in other ways. One possible way is illustrated in FIGS. 9A and 9B. Here, a central louver 72*a* of a louver assembly 74 is flat, i.e., $\theta=\theta$, while all of the other louvers such as 72*b* have a constant louver angle $\theta=\theta_a$. As in the embodiment of FIGS. 8A and 8B the louvers are angled to face away from the center, i.e., toward the nearest end of the louver assembly.

Figure 10:
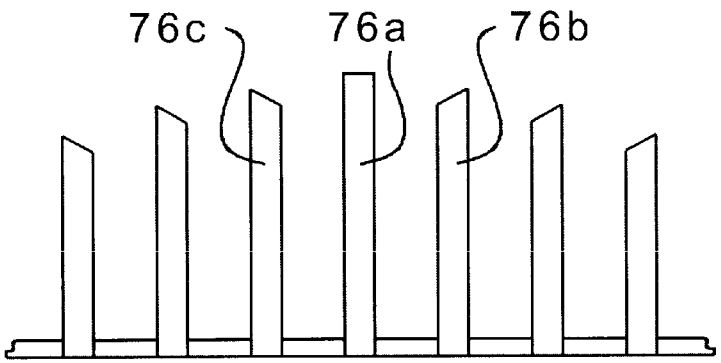
FIG. 10 is a fragmentary side elevation of a luminaire according to the invention showing a second alternative construction for the upper ends of the louvers.
Figure 11:
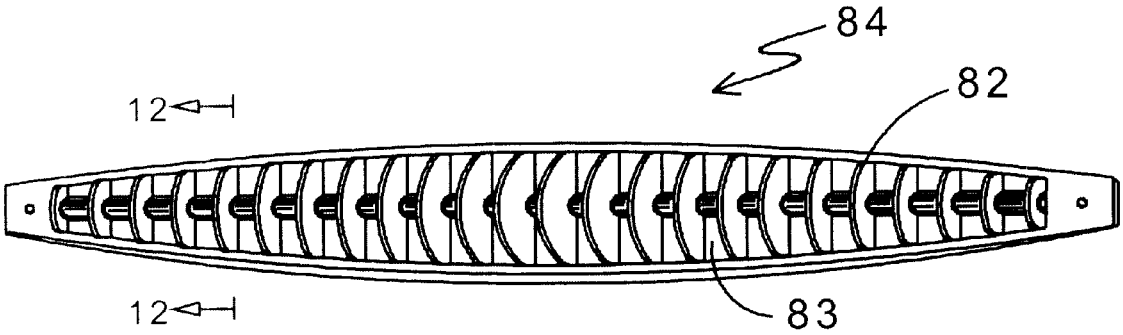
FIG. 11 is a perspective top view of a second embodiment of the luminaire according to the present invention.
Figure 12:
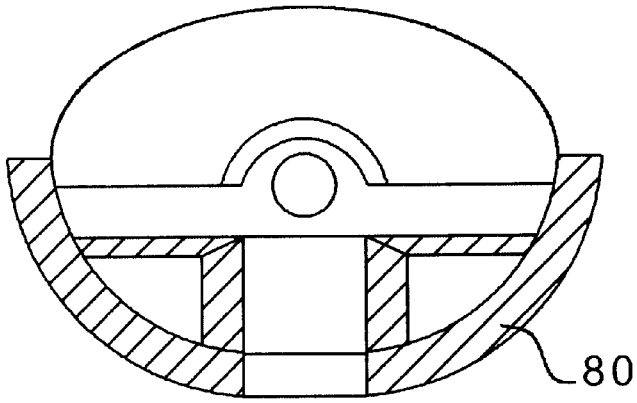
FIG. 12 is a cross-sectional view of the luminaire taken along line 12—12 in FIG. 11.
Figure 13:
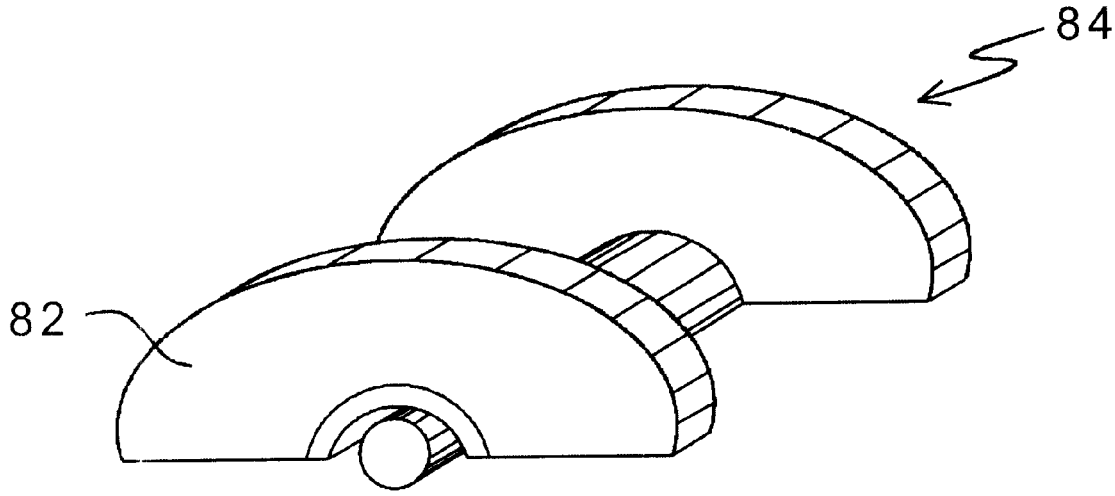
FIG. 13 is a fragmentary perspective view of a portion of the louver assembly shown in FIG. 11.
Figure 14:
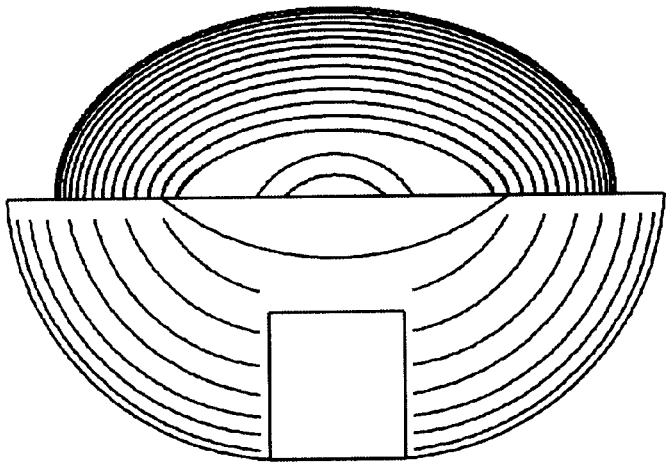
FIG. 14 is an end view of the luminaire shown in FIGS. 11–13.
Figure 15:
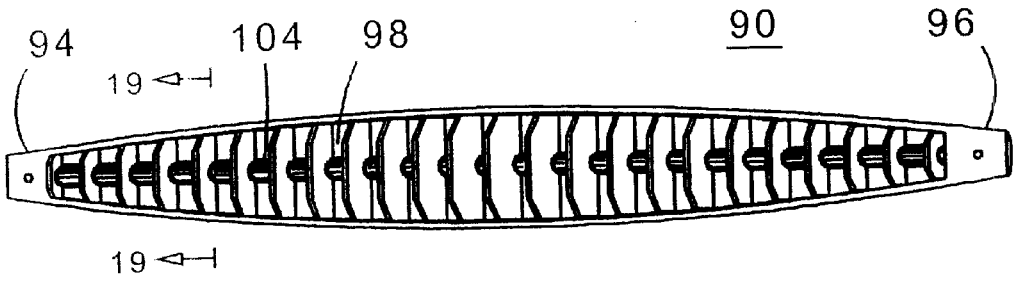
FIG. 15 is a perspective top view of a third embodiment of the luminaire according to the present invention.
Figure 16:
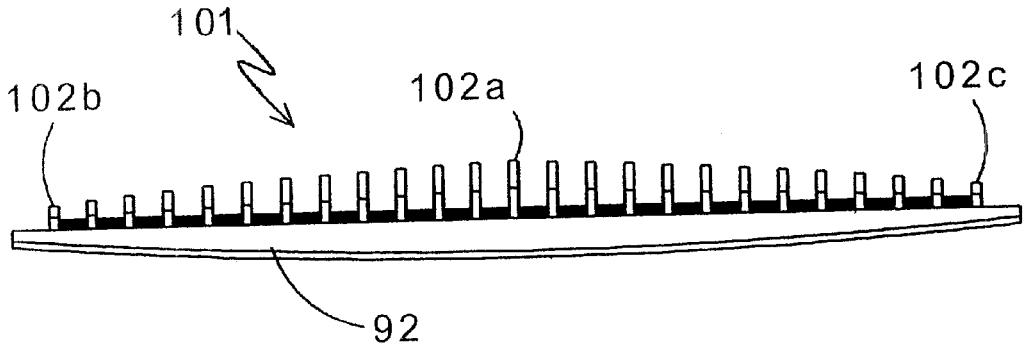
FIG. 16 is a side view of the luminaire shown in FIG. 15.
Figure 17:
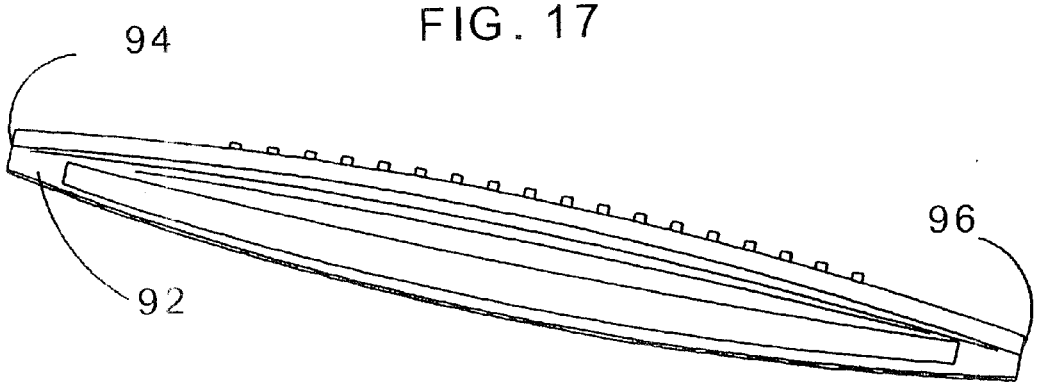
FIG. 17 is a perspective bottom view of the luminaire shown in FIGS. 15 and 16.
Figure 18:
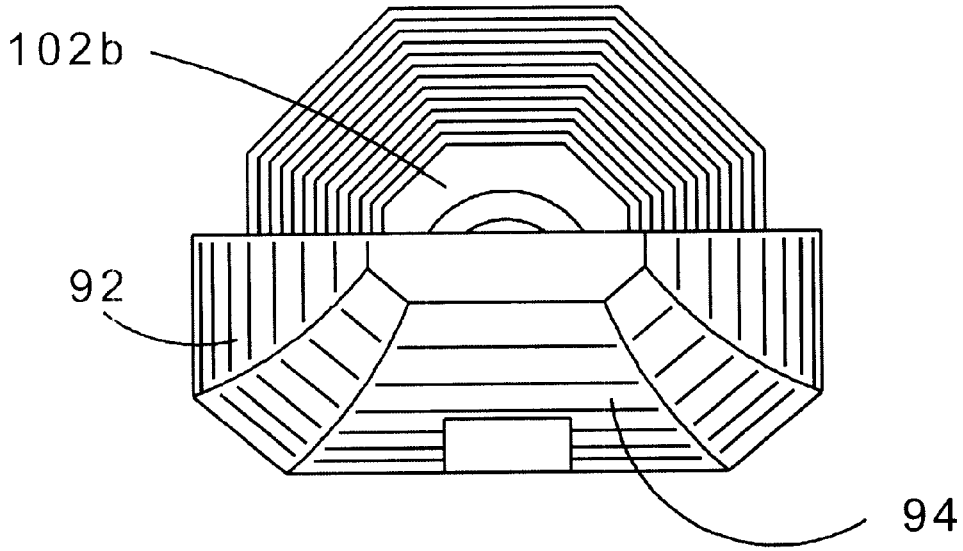
FIG. 18 is an end view of the luminaire shown in FIG. 15.
Figure 19:
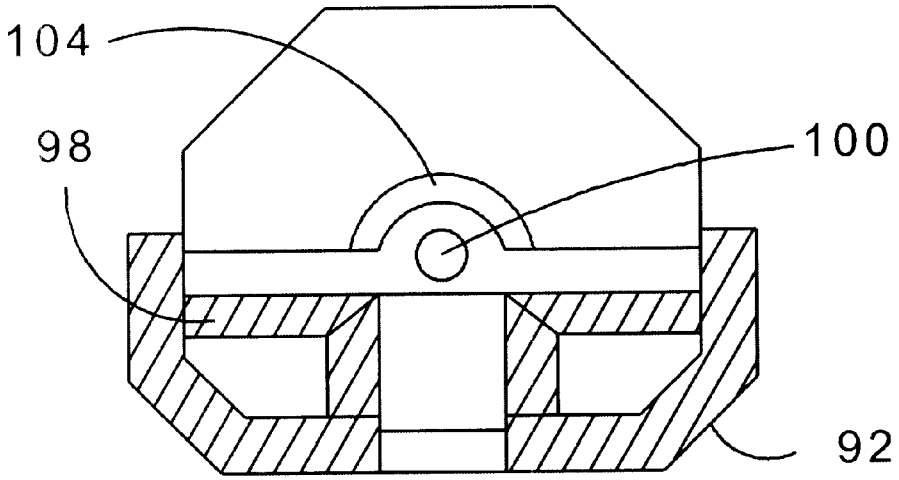
FIG. 19 is a cross-sectional view of the luminaire taken along line 19—19 in FIG. 15.

Another arrangement is shown in FIG. 10, in which the central louver 76*a* is flat, and all the other louvers such as 76*b* and 76*c* have equal bevel angles. In this embodiment, however the beveled faces are angled toward the center, i.e., away from the nearest end of the louver assembly.

Beveling as shown in FIGS. 8 and 9 tends to increase the longitudinal extent of the illumination pattern while an arrangement shown in FIG. 10 tends to produce a relatively shorter illumination pattern.

Generally speaking, it is found that large bevel angles which result in total internal reflection are most effective in redirecting the incoming light, and thus provide the most control of the illumination pattern. In this context, good results are achieved for bevel angles in the range of about 50 degrees.

Moreover, it is not necessary that the bevel angles be constant, or that they vary in a manner that permits the ends of the louver side faces to fall on a smooth curve. In fact, the bevel angle can be varied along the length of the fixture with specific regard to characteristics such as curvature or non-uniformity of the surface to be illuminated so that relatively more or less light is directed unto the surface at different longitudinal positions.

In general, if the surface to be illuminated is substantially flat and uniform, it is found that a constant bevel angle of approximately 50 degrees gives good results.

As previously noted, it is advantageous for the louvers to be made of a transparent material. This is particularly so when the ends are beveled so that light transmitted through the louver is directed toward the illuminated surface through the beveled face. In this connection, it is been found to be particularly advantageous for the side faces of the individual louvers to be translucent. This may be achieved by providing textured surfaces on the side faces, for example, by sand blasting. Also (with reference to FIGS. 5–6), its is found that the portions of supporting member 46 between the louvers should also have a textured surface or should otherwise be made translucent.

FIGS. 11 through 14 show an alternative embodiment of the invention in which the individual louvers are semi-elliptical rather than semi-circular. In this embodiment, the fixture is constructed similarly to that shown in FIGS. 1–7 but here, body 80 and the individual louvers 82 of louver assembly 84 are semi-elliptical with the major axis of each louver extending horizontally across body cavity opening 83 and with the minor axis extending vertically.

Although the individual louvers 82 are illustrated with flat tops, i.e., not beveled, in FIGS. 11 through 14, the louvers may be beveled in this embodiment as well. Likewise, in this embodiment, the support assembly is in the form of a semi-cylindrical tube, but support assembly employing rods 46*a* and 46*b* as shown in FIGS. 4A–6A may also be employed.

The semi-circular louver profile of the embodiment illustrated in FIGS. 1–7, and semi-elliptical profile with horizontal major axes illustrated in FIGS. 11–14, represent preferred configurations, as these give the most uniform illumination. Other configurations are also possible, however within the scope of the invention. For example, louvers 82 shown in FIGS. 11 through 14 may be oriented such that the major axes extend vertically and the minor axes extend horizontally. The extent of illumination transverse of the direction of elongation of the fixture is greater in the embodiment of FIGS. 11 through 14 than in the embodiment of FIGS. 1 through 7 if the louvers are oriented with their minor axes extending vertically. If the louvers are oriented with their major axis extending vertically, a narrower illumination pattern in the transverse direction can be achieved relative to the embodiment of FIGS. 1–7.

FIGS. 15–20 illustrate an example of a louver assembly with polygonal cross-section.

Luminaire 90 according to this embodiment is comprised of a body 92 having an octagonal cross-section tapering toward its ends 94 and 96. The body provides an open cavity 98 in which a lamp 100 is mounted.

Figure 20:
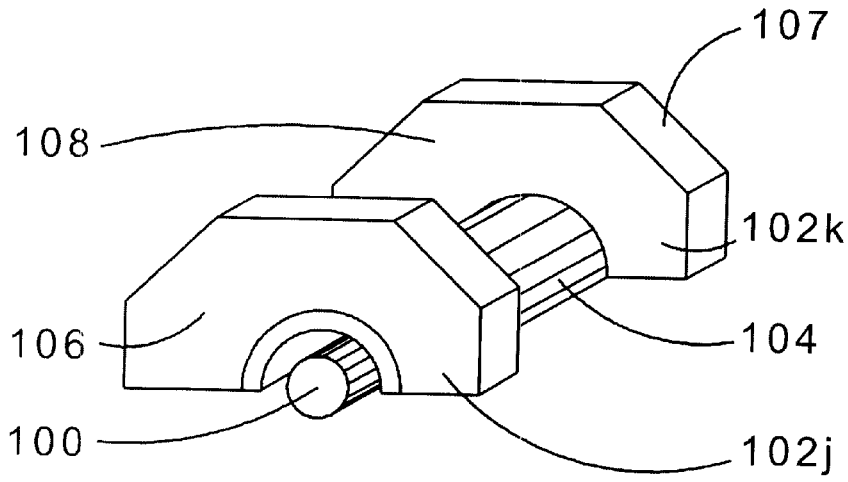
FIG. 20 is a fragmentary perspective view of a portion of the louver assembly shown in FIG. 15.

Louver assembly 101 includes longitudinally spaced individual louvers such as 102*a*–102*c*, located respectively at the center and the ends of the fixture. Except for the octagonal cross-section, the individual louvers comprising louver assembly 102 are the same as those previously described. Thus, as illustrated in FIG. 20, the individual louvers 102*j*, 102*k*, etc. may be integrally mounted on a semi-cylindrical tube 104 which extends the length of the fixture, or on spaced rods as in FIGS. 4A–6A. The peripheral faces 107 of the louvers, though shown without beveled faces, may be beveled as in FIGS. 8–10, and are preferably transparent, with translucent side faces 106 and 108.

Figure 21:
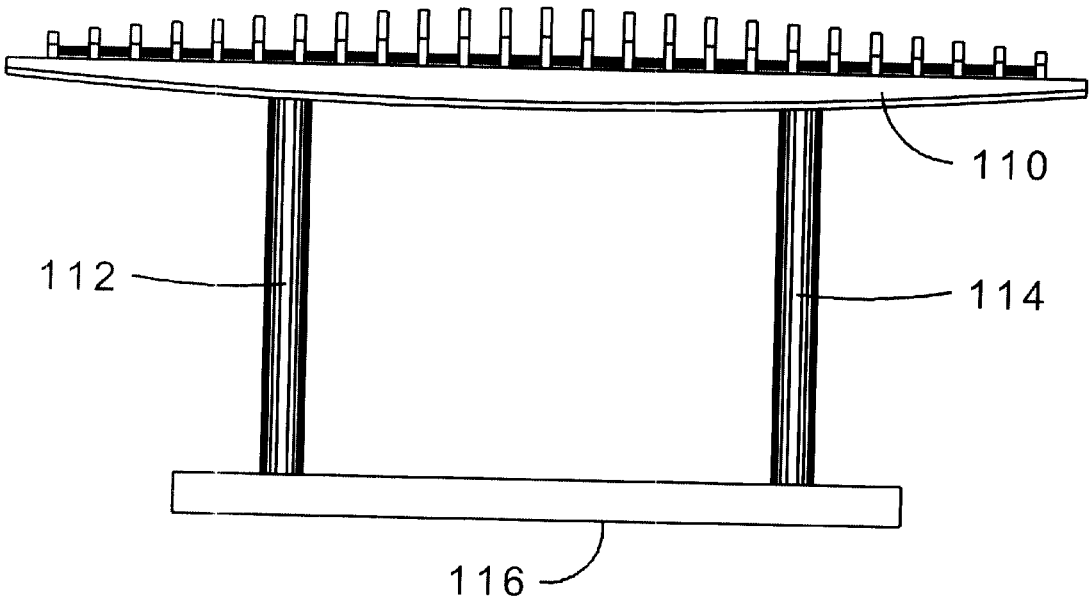
FIG. 21 is a pictorial side view of a further embodiment of the invention designed for table or floor mounting.

FIG. 21 illustrates a further embodiment of the invention adapted for mounting off a ceiling to be illuminated, for example, as a free-standing fixture on a table or floor. In this embodiment, rigid mounting members 112 and 114 extend downwardly from body 110. Mounting members 112 and 114 are secured to a pedestal 116 which may rest on a table, or if mounting members 112 and 114 are of sufficient length, directly on a floor. Alternatively, a luminaire according to this embodiment may be permanently mounted, for example, on the top a kitchen island to provide down-lighting for the surface of the island and up-lighting for the ceiling.

Figure 22:
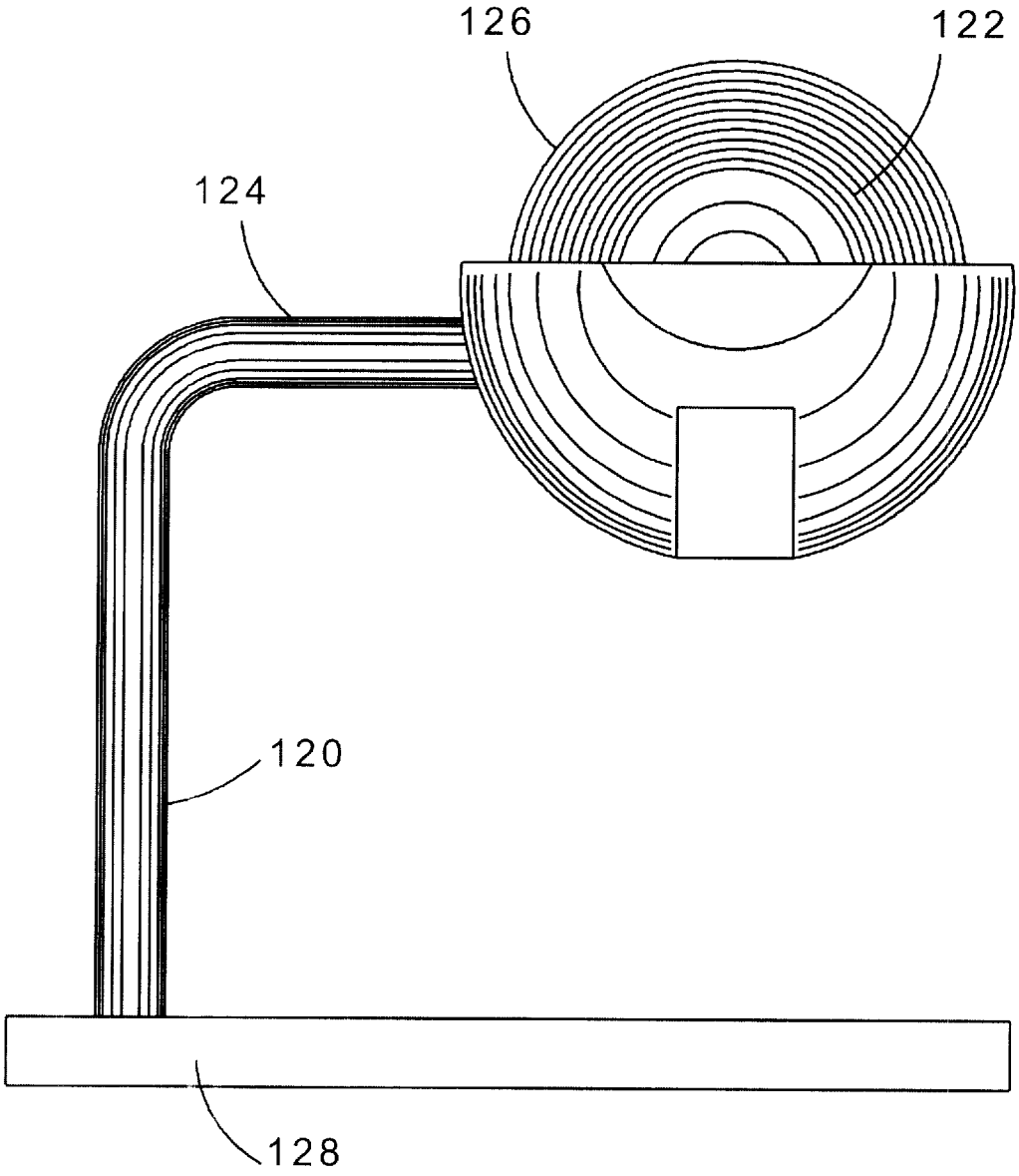
FIG. 22 is a pictorial side view of a further embodiment of the invention showing a cantilever mounting.

FIG. 22 illustrates an end view of further embodiment of the invention adapted for off-ceiling mounting. In this embodiment, several rigid cantilever arms, one of which is shown at 120, are spaced along the length of fixture body 122. The upper ends 124 of respective arms 120 are secured in any suitable fashion to one side 126 of body 122. Alternatively, arms 120 may be arched, and attached to the top of body 122, e.g., on the portion corresponding to flat margin 16 shown in FIG. 4. The other ends of mounting arms 120 are secured to a pedestal 128. This may be adapted for table or floor mounting as in the case of the embodiment of FIG. 21.

In addition to the factors discussed above, several other factors influence light distribution of the luminaire according to this invention. For example, use of a louver profile which tapers toward the ends is preferred over a profile in which the louvers are all the same height, as this tends to increase the amount of light sent to low vertical angles along the lamp axis and helps reduce the "hourglass" effect mentioned earlier.

Further, efficiency, i.e., brightness of illumination, varies inversely with the number of louvers, but use of too few louvers results in non-uniform illumination. Similarly, the thickness of the individual louvers,, i.e., in the longitudinal direction, must also be considered. In general, greater shadowing results as the thickness of the louvers is increased, but if the louvers are too thin, the beneficial effects of beveling is reduced. Also, it is preferable for the louvers to be of equal thickness to avoid non-uniform illumination which can result due to the prismatic effect of beveling.

Taking all the factors discussed above into consideration, for a fixture having a louver assembly about 1120 mm long, it is found that acceptable results are obtained using between 15 and 29 louvers each louver having a thickness of about 5 mm. The optimum result appears to be achieved with about 23 louvers. Thus, good results can be achieved if the ratio of the louver spacing to thickness is in the range of about 7:1 to about 14:1, with a preferred ratio in the range of about 10:1 to about 11:1.

Although the present invention has been described in relation to particular embodiments and variations thereof, other variations and modifications will be apparent to those skilled in the art. In one such variation, the louvers could be oriented such that the planar surfaces thereof lie transversely of the longitudinal axis of the fixture, but tilted (i.e., not perpendicular) to the opening of the body cavity. In another variation, the planar surfaces of the louvers could lie in an orientation other than transversely to the longitudinally. It is intended, therefore, that the present invention be limited not by the specific disclosure herein, but only by the appended claims.

What is claimed is:

1. A lighting fixture comprised of:

an elongated tapered body having an axis of elongation extending in a first direction, with the body including a cavity having an opening therein;

a fixture mounting assembly for positioning the fixture with the cavity opening oriented to provide up-lighting;

a lamp mounting assembly for positioning a lamp in the cavity so it extends in the first direction with the lamp exposed upwardly; and a louver assembly including a plurality of louvers spaced along the axis of elongation, with the louvers extending outward from the body cavity opening and transversely of the axis of elongation, the louver assembly being operative to direct light outwardly in a substantially uniform pattern extending in the first direction and transversely of the first direction.

2. A lighting fixture as described in claim 1, wherein the body has an elongated opening on a side opposite to the louver assembly that extends in the first direction, the opening being operative to provide down-lighting.

3. A lighting fixture as described in claim 2, further including a light diffuser covering the elongated opening.

4. A lighting fixture as described in claim 1, wherein the louvers are comprised of partial disks, with the sizes of the louvers decreasing progressively from the center of the louver assembly to its ends.

5. A lighting fixture as described in claim 4, wherein the louvers have semi-circular perimeters.

6. A lighting fixture as described in claim 4, wherein the louvers have semi-elliptical perimeters, with the minor axes thereof extending vertically.

7. A lighting fixture as described in claim 4, wherein the louvers have semi-elliptical perimeters, with the major axes thereof extending vertically.

8. A lighting fixture as described in claim 4, wherein the louvers have polygonal perimeters.

9. A lighting fixture as described in claim 1, wherein the louvers decrease in size progressively from the center of the louver assembly to its ends.

10. A lighting fixture as described in claim 1, wherein the ratio of the spacing between the louvers and the thickness of the louvers is between about 7:1 and about 14:1.

11. A lighting fixture as described in claim 1, wherein the ratio of the spacing between the louvers and the thickness of the louvers is between about 10:1 and about 11:1.

12. A lighting fixture as described in claim 1, wherein the louver assembly is further comprised of an elongated supporting structure on which the louvers are mounted, the louver assembly being installable and removable as a single unit.

13. A lighting fixture as described in claim 12, wherein the supporting structure is comprised of an elongated partially tubular member having an inner surface that partially surrounds the area which receives the lamp and an outer surface on which the louvers are mounted in longitudinally spaced relationship.

14. A lighting fixture as described in claim 13, wherein the supporting structure is light transmissive.

15. A lighting fixture as described in claim 13, wherein the supporting structure is light transmissive, and the portions of the outer surface between the louvers are translucent.

16. A lighting fixture as described in claim 13, wherein the supporting structure has an arcuate outer surface, and the louvers each include an arcuate recess which receives the outer surface of the shell.

17. A lighting fixture as described in claim 13, wherein the louvers are comprised of partial discs having longitudinally spaced side faces and beveled peripheral faces.

18. A lighting fixture as described in claim 17, wherein the beveled faces all have a substantially constant bevel angle.

19. A lighting fixture as described in claim 17, wherein the beveled faces are angled toward the nearest end of the louver assembly.

20. A lighting fixture as described in claim 17, wherein the bevel angles increase progressively from the center of the louver assembly toward the ends of the louver assembly.

21. A lighting fixture as described in claim 20, wherein the maximum bevel angle is about 50 degrees.

22. A lighting fixture as described in claim 20, wherein the louvers decrease progressively in size from the center of the louver assembly to its ends.

23. A lighting fixture as described in claim 22, wherein the intersections of the beveled faces and the side faces are bounded by a substantially smooth curve which defines an arcuate profile for the top of the louver assembly.

24. A lighting fixture as described in claim 22, wherein the louvers have semi-circular perimeters.

25. A lighting fixture as described in claim 22, wherein the louvers have semi-elliptical perimeters, with the major axes thereof extending vertically.

26. A lighting fixture as described in claim 25, wherein the louvers have semi-elliptical perimeters, with the minor axes thereof extending vertically.

27. A lighting fixture as described in claim 24, wherein the louvers have polygonal perimeters.

28. A lighting fixture as described in claim 1, wherein the louvers are comprised of partial discs having longitudinally spaced side faces and beveled peripheral faces.

29. A lighting fixture as described in claim 28, wherein the beveled faces are angled toward the nearest end of the louver assembly.

30. A lighting fixture as described in claim 28, wherein the bevel angles increase progressively from the longitudinal center of the louver assembly toward the end of the louver assembly.

31. A lighting fixture as described in claim 30, wherein the louvers decrease progressively in size from the center of the louver assembly to its ends.

32. A lighting fixture as described in claim 31, wherein the intersections of the beveled faces and the side faces are bounded by a substantially smooth curve which defines an arcuate profile for the top of the louver assembly.

33. A lighting fixture as described in claim 28, wherein the bevel angle is about 50 degrees.

34. A lighting fixture as described in claim 1, further including a reflector positioned to direct light upward from a lamp mounted in the fixture.

35. A lighting fixture as described in claim 12, wherein the supporting structure is comprised of a plurality of spaced tubular members that extend the length of the louver assembly.

36. A lighting fixture as described in claim 35, wherein the tubular members extend through openings in the individual louvers.

37. A lighting fixture as described in claim 35, wherein the tubular members are rods that extend through openings in the individual louvers.

38. A lighting fixture as described in claim 37, wherein the individual louvers include a recess that receives a lamp mounted in the lamp mounting assembly.

39. A lighting fixture as described in claim 38, further including a reflector positioned to direct light upward from a lamp mounted in the fixture.

40. A lighting fixture as described in claim 35, wherein the individual louvers include a recess that receives a lamp mounted in the lamp mounting assembly.

41. A lighting fixture as described in claim 1, wherein the fixture mounting assembly includes mounting members spaced along the axis of elongation of the fixture, the members extending downwardly for mounting the fixture on a surface spaced from a ceiling.

42. A lighting fixture as described in claim 41, further including a base to which the mounting members are attached.

43. A lighting fixture as described in claim 41, wherein the fixture is cantilevered on the mounting members.

44. A lighting fixture as described in claim 43, further including a base to which the mounting members are attached.

45. A lighting fixture comprised of:

an elongated tapered body having an axis of elongation extending in a first direction, with the body including a cavity having an opening therein;

a fixture mounting assembly for positioning the fixture with the cavity opening oriented to provide lighting directed toward a surface;

a lamp mounting assembly that positions a lamp in the cavity so it extends in the first direction, with the lamp exposed to provide illumination toward the surface; and a louver assembly including a plurality of louvers spaced along the axis of elongation, the louvers extending outward from the body cavity opening and transversely of the axis of elongation, the louver assembly being operative to direct light toward the surface to be illuminated in a substantially uniform pattern extending in the first direction and transversely of the first direction.

46. A lighting fixture as described in claim 45, wherein the body has an elongated opening on a side opposite to the louver assembly and extending in the first direction, the opening being operative to provide illumination in a direction opposite to the light directed toward the surface to be illuminated.

47. A lighting fixture as described in claim 46, further including a light diffuser covering the elongated opening.

48. A lighting fixture as described in claim 45, wherein:

the surface to be illuminated is a wall; and the fixture mounting assembly includes members spaced along the axis of elongation of the fixture, the members extending outwardly for attaching the fixture to the wall.

* * * * *